US005782623A

United States Patent [19]

Brox

[11] Patent Number: 5,782,623

[45] Date of Patent: Jul. 21, 1998

[54] INTERNAL TOOTHED BELT PUMP

[76] Inventor: Dieter Brox, Wittenstrasse 2 (c)., D-38640 Goslar, Germany

[21] Appl. No.: 722,244

[22] PCT Filed: Apr. 25, 1995

[86] PCT No.: PCT/EP95/01564

§ 371 Date: Dec. 12, 1996

§ 102(e) Date: Dec. 12, 1996

[87] PCT Pub. No.: WO95/29339

PCT Pub. Date: Nov. 2, 1995

[30] Foreign Application Priority Data

Apr. 25, 1994 [DE] Germany ..... 44 14 319.2

[51] Int. Cl.[6] ..... F04C 2/10; F04C 5/00

[52] U.S. Cl. ..... 418/153; 418/170

[58] Field of Search ..... 418/152, 153, 418/156, 170

[56] References Cited

U.S. PATENT DOCUMENTS

| | | | |
|---|---|---|---|
| 2,745,355 | 5/1956 | Mosbacher | 418/153 |
| 5,032,069 | 7/1991 | Parsons | 418/170 |

FOREIGN PATENT DOCUMENTS

| | | | |
|---|---|---|---|
| A 207 693 | 2/1960 | Austria . | |
| 2622145 | 6/1977 | Germany | 418/170 |
| A 25 58 074 | 7/1977 | Germany . | |
| C 25 60 128 | 7/1977 | Germany . | |
| 4218148 | 10/1992 | Germany | 418/153 |
| A 42 18 148 | 10/1992 | Germany . | |
| 1355760 | 11/1987 | U.S.S.R. | 418/170 |
| 1399504 | 5/1988 | U.S.S.R. | 418/153 |

*Primary Examiner*—John J. Vrablik

*Attorney, Agent, or Firm*—Oblon, Spivak, McClelland, Maier & Neustadt, P.C.

[57] ABSTRACT

The invention relates to an internal toothed belt pump, in particular an internal toothed belt pump which is self-priming and can deliver and meter also non-lubricant fluids at a controlled pump speed and medium pressure.

7 Claims, 3 Drawing Sheets

INTERNAL TOOTHED BELT PUMP

The invention concerns an internal toothed belt pump, in particular an internal toothed belt pump which, being self-priming, can deliver and meter even non-lubricating fluids at a regulated speed in the medium pressure range.

Originally pumps had been developed for delivering water. It was possible for the few technical requirements resulting therefrom to be met with a small number of different types. Nowadays, a large number of different types of pumps are required in order to satisfy the specific requirements of the many areas of use for all kinds of fluids. Pups can be divided into two principal groups, the group of rotary pumps and the group of positive-displacement pumps.

Rotary pumps are suitable for the delivery of widely varying, even non-lubricating fluids, but they are generally not self-priming and they are not suitable as regulated-speed pumps over the entire range of speeds.

Positive-displacement pumps, primarily toothed gear pumps and screw spindle pumps, like the other known positive-displacement pumps, are sensitive to foreign bodies and are not suitable for non-lubricating fluids, without particular precautions being taken.

Among positive-displacement pumps, U.S. Pat. No. 2,745,355 discloses a toothed belt pump having a plurality of toothed pulleys which are in engagement with a toothed belt. In that pump, the suction chamber and the pressure chamber must be separated from each other by separate spacer portions. DE-C-25 60 128 discloses a pump with a delivery belt which circulates on two belt pulleys. That toothed belt pump involves an operating principle which is different from that of U.S. Pat. No. 2,745,355 insofar as an alteration to the curvature of the path of movement means that the working chambers which are disposed between the tooth tips change in cross-section. DE-C-42 18 148 describes a toothed belt pump with a belt pulley and two belt guide rollers which bear laterally thereagainst and which provide for circulatory movement of an endless toothed belt with outwardly facing teeth, within the pump casing. By virtue of the arrangement of the toothed belt pulley with the laterally disposed guide rollers, the toothed belt which passes therearound is subjected to a considerable flexural change with counter-flexing, and that can result in material fatigue and belt fracture after a certain period of operation.

DE-A-25 58 074 already discloses an internal toothed belt pump whose mode of operation is similar to the pump disclosed in DE-C-25 60 128.

The object of the invention is to design an internal toothed belt pump which while being self-priming can also deliver and meter non-lubricating fluids at a regulated speed in the medium pressure range.

That object is attained by providing a casing having an inside wall which in one portion has a first radius and the remainder of the inside wall is formed of a second radius. A toothed pulley positioned in the cylindrical casing and is rotatable. A drive shaft is mounted in the casing. The drive shaft is positively connected to the toothed pulley so as to be able to rotate the toothed pulley. Furthermore, a toothed belt having an internal tooth configuration is provided which can accommodate the first and second radii of the inside wall of the casing. Two guide rollers are rotatably mounted in the casing and provide support against the back of the toothed belt so that the toothed belt fully engages the external tooth configuration of the toothed pulley. The region of fall engagement of the teeth of the pulley and the belt is denoted as the engagement region. A suction chamber and a pressure chamber lie on either side of the engagement region.

The invention will be further described hereinafter by means of an embodiment and illustrated with reference to drawings.

FIG. 4 shows a perspective view of an assembly drawn with the casing cover screwed on.

Figure 1:
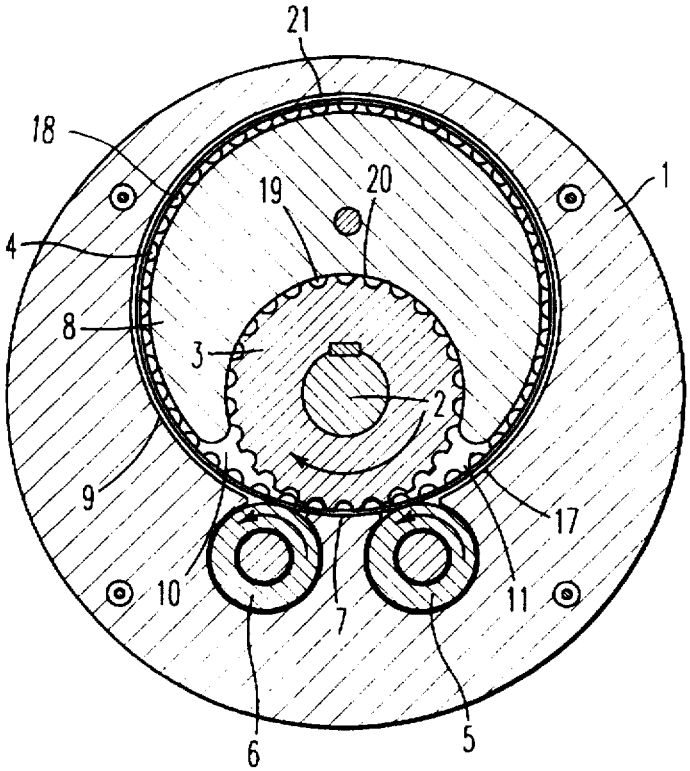
FIG. 1 is a front view and section of an internal toothed belt pump.
Figure 2:
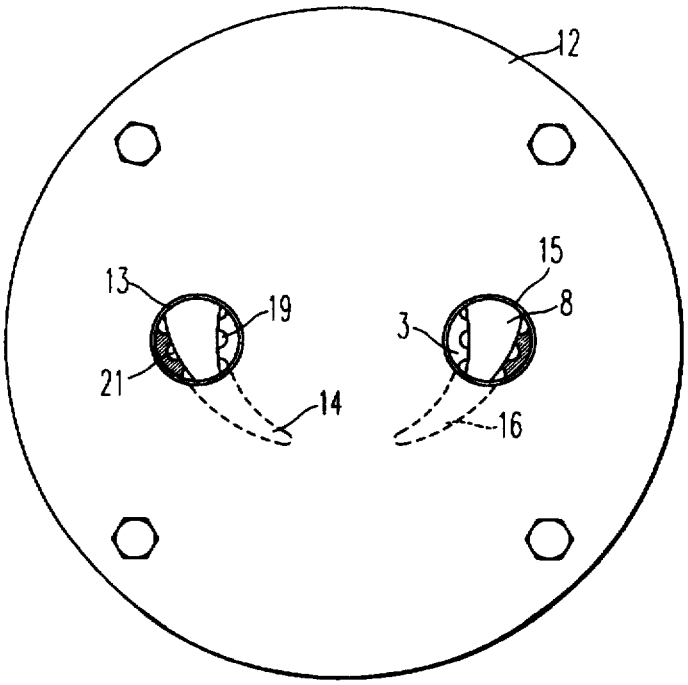
FIG. 2 is a front view of a toothed belt pump with casing cover screwed thereon.

The internal toothed belt pump comprises a cylindrical casing 1 in which a rotatable, centrally mounted drive shaft 2 carries a toothed pulley 3, with a connection in positively locking relationship. The internal tooth configuration of the toothed belt 4 in conjunction with the rotatably mounted guide rollers 5 and 6 which bear against the back of the toothed belt, and the toothed pulley 3, provides a desirable engagement relationship, that is to say, all teeth of the toothed pulley 3 and the toothed belt 4, being teeth which are within the engagement region 27 between the guide rollers 5 and 6, are always fully in engagement. In the engagement region 27, the pitch circle of the toothed belt 4 is adapted by the guide rollers 5 and 6 to the pitch circle radius 25 around the centre point 23 of the toothed pulley 3. Also, starting from the centre point 23 of the toothed pulley 3, the radius 26 of the back of the toothed belt is identical to the radius of the inside wall of the casing, within the engagement region 27, but with a minor running clearance (gap).

After leaving the engagement region 27, when rolling over the guide roller 6 in the direction of rotation, the toothed belt 4 moves with its tooth tips slidingly and sealingly along a circular orbital path about the second centre point 22 with the second pitch circle radius 24 on the peripheral surface 18 of the sickle-shaped filling portion 8, while the back of the belt moves along the same orbital path with a small gap and in a contact-free manner, relative to the inside wall 9 of the casing. The circular orbital path ends at re-entry into the engagement region 27 and the change to the centre point 23 of the toothed pulley; a fresh revolution of the toothed belt 4 begins.

Between the end of the engagement region 27, as viewed in the direction of rotation of the meshing tooth configuration, a suction chamber 10 is formed after opening of the tooth configuration; the suction chamber 10 is delimited in terms of volume by the toothed surface of the toothed belt 4, the toothed pulley 3 and the sickle-shaped filling portion 8. Likewise, upon closure of the tooth configuration, at the beginning of the engagement region 27, a pressure chamber 11 is formed by the surfaces of the tooth configurations of the toothed belt 4, the toothed pulley 3 and the sickle-shaped filling portion 8. The suction and pressure chambers 10 and 11 are closed off laterally by the pump casing and by the cover 12 of the pump.

A flow transfer passage 14 is provided in the inside wall in the cover 12 for communicating the pump intake 13 on the suction side and the suction chamber, while a flow transfer passage 16 is incorporated for communicating the pump outlet 15 on the pressure side, and the pressure chamber 11.

In the region of the pressure chamber 11 a communicating grove 17 is incorporated laterally into the surface of the pump casing, whereby the pressure on the toothed belt 4 is compensated.

The toothed pulley 3 is driven in rotation as indicated by the arrow by the drive of the drive shaft 2, by way of a positively locking connection. The toothed belt 4 which is in full tooth engagement with the toothed pulley 3 within the engagement region 27 is also moved outside the angular region 27 on a circular orbital path but about the centre point 22 with the pitch circle radius 24 between the casing wall 9 and the peripheral surface 18 of the sickle-shaped filling portion 8, in which case it moves along a path from the suction chamber 10 to the pressure chamber 11. From the pump intake 13 at the suction side, by way of the flow transfer passage 14, the delivery medium is transported by the gaps 19 between the teeth of the belt pulley 3 and the gaps 21 between the teeth of the toothed belt 4, along the boundary surfaces 18 and 20 respectively, to the pressure chamber 11 where the delivery medium is displaced out of the gaps 19 and 21 between the teeth, by way of the flow transfer passage 16, to the pump outlet 15 on the pressure side, by virtue of the meshing tooth configurations of the toothed pulley 3 and the toothed belt 4.

I claim:

1. An internal toothed belt pump comprising:

a casing having a substantially cylindrical inside wall formed with both a first radius and a second radius larger than the first radius;

a toothed pulley having an external tooth configuration, said toothed pulley being situated in said casing;

a drive shaft mounted in said casing and rotatably driving said toothed pulley;

a toothed belt positioned in said casing around said toothed pulley and having an internal tooth configuration cooperating with said toothed pulley to define a suction chamber and a pressure chamber, the toothed belt having a back surface facing the inside wall of the casing, said back surface of said toothed belt conforming to the variable shape of said inside wall of said casing; and two guide rollers rotatably mounted in a portion of said casing corresponding to said first radius, said guide rollers bearing against said back of said toothed belt so as to form an engagement region within which said internal tooth configuration of said toothed belt is fully engaged with said external tooth configuration of said toothed pulley.

2. An internal toothed belt pump as set forth in claim 1, further comprising a flow transfer passage located in said cover so as to provide communication between said suction chamber and an intake of said pump, and wherein within said engagement region a running clearance exists between a radius of said back surface of said toothed belt and said first radius of said inside wall of said casing, and further comprising a sickle-shaped filling portion located in said casing, said sickle-shaped filling portion being located between said toothed pulley and said toothed belt outside of said engagement region, wherein said toothed belt rotates on a substantially circular orbital path along said second radius of said inside wall of said casing, tips of teeth of said toothed belt lie between said suction chamber and said pressure chamber, said tips of teeth of said toothed belt being slidingly and sealingly engaged against a peripheral surface of said sickle-shaped filling portion, and first and second sealed tooth gaps formed by tips of teeth of said toothed belt and said toothed pulley with said peripheral surface of said sickle-shaped filling portion, respectively, convey fluid from said suction chamber to said pressure chamber, and wherein said suction chamber is provided at an end of said engagement region and said pressure chamber is provided at another end of said engagement region, said suction and pressure chambers being volumetrically delimited by the tooth configurations of the toothed belt and the toothed pulley, said sickle-shaped filling portion, a lateral pump casing and a cover.

3. An internal toothed belt pump as set forth in claim 1, further comprising a flow transfer passage located in said cover so as to provide communication between said pressure chamber and an outlet of said pump, and wherein within said engagement region a running clearance exists between a radius of said back surface of said toothed belt and said first radius of said inside wall of said casing, and further comprising a sickle-shaped filling portion located in said casing, said sickle-shaped filling portion being located between said toothed pulley and said toothed belt outside of said engagement region, wherein said toothed belt rotates on a substantially circular orbital path along said second radius of said inside wall of said casing, tips of teeth of said toothed belt lie between said suction chamber and said pressure chamber, said tips of teeth of said toothed belt being slidingly and sealingly engaged against a peripheral surface of said sickle-shaped filling portion, and first and second sealed tooth gaps formed by tips of teeth of said toothed belt and said toothed pulley with said peripheral surface of said sickle-shaped filling portion, respectively, convey fluid from said suction chamber to said pressure chamber, and wherein said suction chamber is provided at an end of said engagement region and said pressure chamber is provided at another end of said engagement region, said suction and pressure chambers being volumetrically delimited by the tooth configurations of the toothed belt and the toothed pulley, said sick-shaped filling portion, a lateral pump casing and a cover.

4. An internal toothed belt pump as set forth in claim 1, further comprising a communication groove located in said surface of said cylindrical casing within said pressure chamber, wherein said communication groove compensates the pressure on said toothed side of said toothed belt with that of said back of said toothed belt, and wherein within said engagement region a running clearance exists between a radius of said back surface of said toothed belt and said first radius of said inside wall of said casing, and further comprising a sickle-shaped filling portion located in said casing, said sickle-shaped filling portion being located between said toothed pulley and said toothed belt outside of said engagement region, wherein said toothed belt rotates on a substantially circular orbital path along said second radius of said inside wall of said casing, tips of teeth of said toothed belt lie between said suction chamber and said pressure chamber, said tips of teeth of said toothed belt being slidingly and sealingly engaged against a peripheral surface of said sickle-shaped filling portion, and first and second sealed tooth gaps formed by tips of teeth of said toothed belt and said toothed pulley with said peripheral surface of said sickle-shaped filling portion, respectively, convey fluid from said suction chamber to said pressure chamber, and wherein said suction chamber is provided at an end of said engagement region and said pressure chamber is provided at another end of said engagement region, said suction and pressure chambers being volumetrically delimited by the tooth configurations of the toothed belt and the toothed pulley, said sickle-shaped filling portion, a lateral pump casing and a cover.

5. An internal toothed belt pump as set forth in claim 2, further comprising a second flow transfer passage located in said cover so as to provide communication between said pressure chamber and an outlet of said pump.

6. An internal toothed belt pump as set forth in claim 2, further comprising a communication groove located in said surface of said cylindrical casing within said pressure chamber, wherein said communication groove compensates the pressure on said toothed side of said toothed belt with that of said back of said toothed belt.

7. An internal toothed belt pump as set forth in claim 3, further comprising a communication groove located in said surface of said cylindrical casing within said pressure chamber, wherein said communication groove compensates the pressure on said toothed side of said toothed belt with that of said back of said toothed belt.

* * * * *

UNITED STATES PATENT AND TRADEMARK OFFICE

CERTIFICATE OF CORRECTION

PATENT NO. : 5782623

DATED : July 21, 1998

INVENTOR(S) : Dieter BROX

Figure 3:
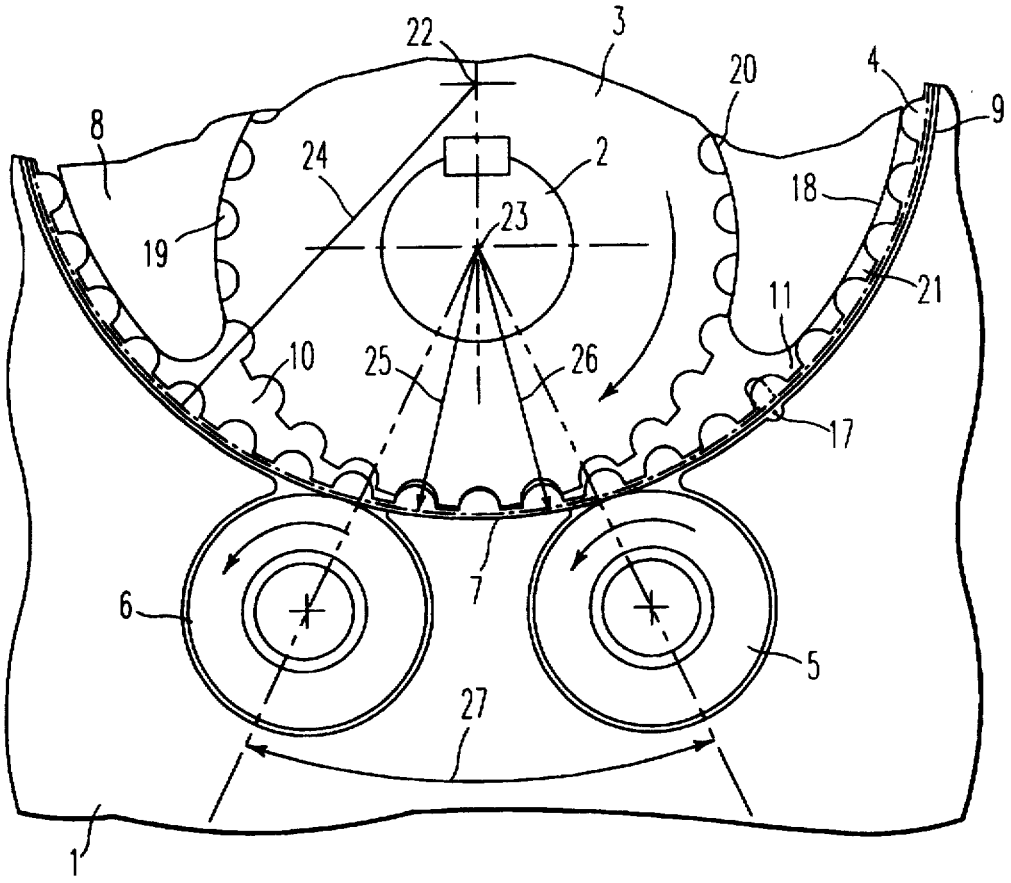
FIG. 3 shows a detail on an enlarged scale in the region of the tooth engagement of the toothed belt and the toothed pulley.
Figure 4:
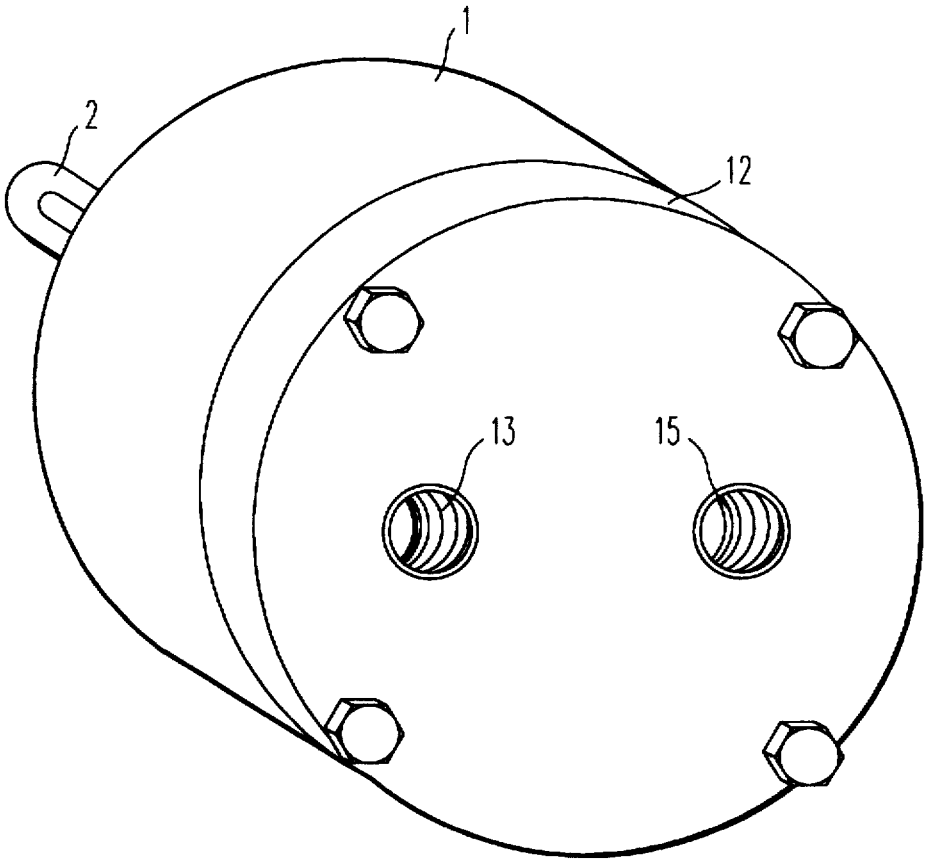
Figure 3:
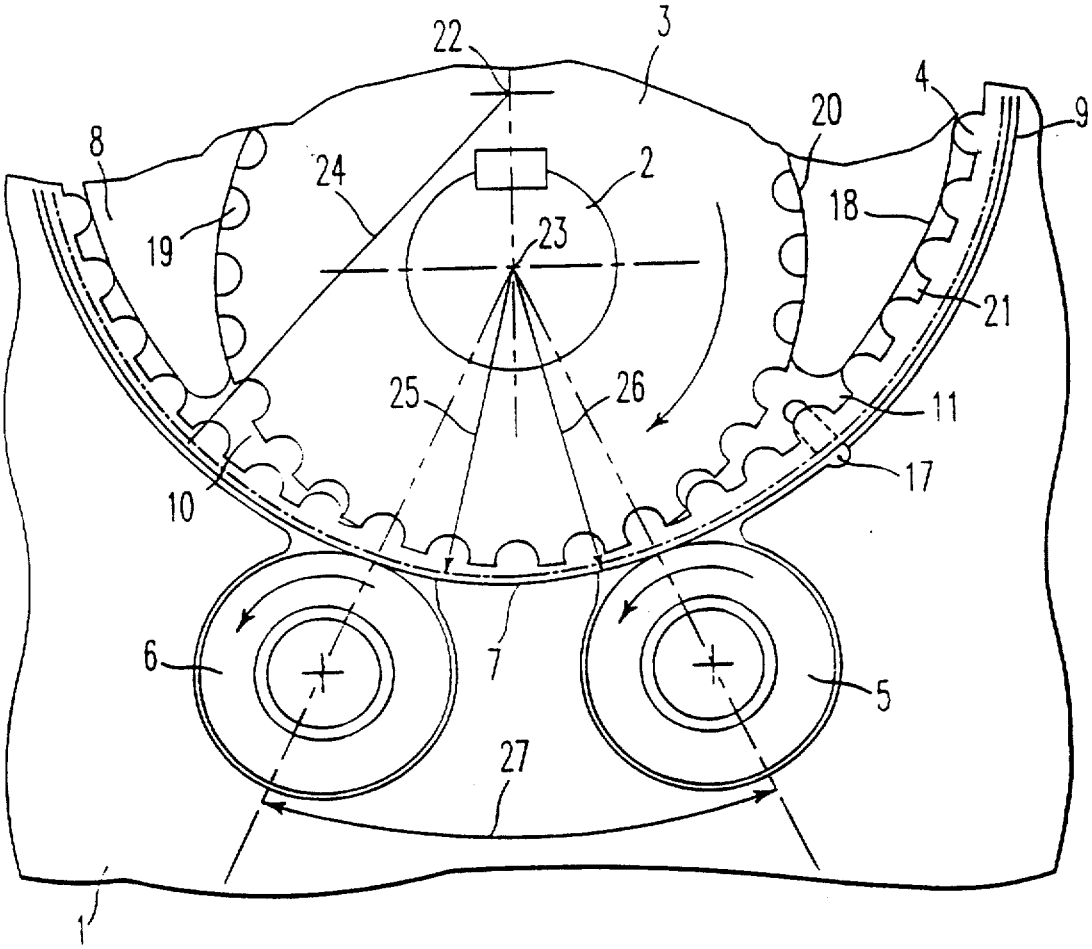

It is certified that error appears in the above-identified patent and that said Letters Patent is hereby corrected as shown below:

In the drawings,
Please replace the formal drawing of Figure 3 with the attached new formal drawing of Figure 3.

The attached Figure 3 correctly illustrates the engagement of the teeth of the toothed belt 4 with the teeth of the toothed pulley 3 within the engagement region 27 between guide rollers 5 and 6. Figure 3, as published on July 21, 1998, does not illustrate the proper engagement of the toothed belt 4 with the toothed pulley 3.

Signed and Sealed this

Twenty-fifth Day of May, 1999

*Attest:*

Q. TODD DICKINSON

*Attesting Officer*

*Acting Commissioner of Patents and Trademarks*